US005190018A

United States Patent [19]

Costello et al.

[11] Patent Number: 5,190,018

[45] Date of Patent: Mar. 2, 1993

[54] INTERNAL-COMBUSTION ENGINE HYDROCARBON SEPARATOR

[75] Inventors: John W. Costello, Newhall; Dino J. DeFilippi, Calabasas; Jonathan D. Kraut, Huntington Beach, all of Calif.

[73] Assignee: Performa Tech Incorporated, Calabasas, Calif.

[21] Appl. No.: 912,698

[22] Filed: Jul. 13, 1992

[51] Int. Cl.[5] ..... F02B 25/06

[52] U.S. Cl. ..... 123/573

[58] Field of Search ..... 123/573, 572

[56] References Cited

U.S. PATENT DOCUMENTS 3,989,017 11/1976 Reece ..... 123/572

4,308,847 1/1982 Ruizzo, Jr. ..... 123/573

*Primary Examiner*—Noah P. Kamen

*Attorney, Agent, or Firm*—Francis X. LoJacono

[57] ABSTRACT

The present invention comprises a method and apparatus for trapping and separating contaminated elements found in crankcase emissions that are released through a positive crankcase ventilation system of a combustible engine, the apparatus being defined as a canister having a reservoir chamber in which is mounted a ceramic permanent magnet and a separator screen, whereby hydrocarbons, crankcase oil and unburned combustible fuel enter the canister passing through the north and south magnetic fields of the magnet and are then separated through the separator screen, after which the hydrocarbons, crankcase oil and other associated metals are trapped in the reservoir and the intermixed unburned volatile vaporized fuel mixture is returned to the combustion chambers of the engine to be reburned.

14 Claims, 1 Drawing Sheet

INTERNAL-COMBUSTION ENGINE HYDROCARBON SEPARATOR

BACKGROUND OF THE INVENTION

1. Field of the Invention

The present invention relates generally to a hydrocarbon separator for internal-combustion engines and more particularly to a method and apparatus for trapping and separating contaminates found in crankcase emission that is released through the positive crankcase ventilation system of a combustible engine. The contaminated elements enter a canister and are passed through a magnetic field, after which the intermixed hydrocarbons, crankcase oil and combustible gases are separated and trapped in the reservoir of the canister, whereby the unburned volatile fuel mixture is separated and returned to the combustion chamber of the engine to be burned therein.

2. Description of the Prior Art

As is well known in the art, various problems and difficulties are encountered in providing suitable means for separating the contaminants that are emitted from the crankcase of a combustion engine.

Many types of automotive-crankcase, emission-control systems and devices are in use as well as many that have been tried and suggested. However, these devices have various limitations that restrict their use and often cause damage to an engine. Most vehicles having combustion-type engines come under strict emission-control regulations that require them to be provided with a means to burn or reburn exhaust or crankcase fumes.

All of the crankcase-emission control systems that are presently employed have greatly reduced the discharging into the atmosphere of pollutants from the exhaust systems of combustion engines. However, the resultant performance of vehicle engines has not been too impressive. The life of an engine is often considerably reduced due to contamination by sludge or water which are either not removed from the engine or are allowed to remain mixed with the oil in the crankcase.

As examples of emission-control devices and systems one may refer to the following United States patents:

U.S. Pat. No. 3,073,293 to R. C. Barker
U.S. Pat. No. 3,246,639 to J. J. Oliver
U.S. Pat. No. 3,779,221 to J. J. Gartner
U.S. Pat. No. 4,013,051 to R. M. Parcels
U.S. Pat. No. 4,136,650 to A. Manookian Jr.
U.S. Pat. No. 4,269,607 to R. A. Walker
U.S. Pat. No. 4,370,971 to E. W. Bush
U.S. Pat. No. 4,627,406 to Kyoji Namiki Urawa et al

SUMMARY AND OBJECTS OF THE INVENTION

The present invention defines a hydrocarbon separator for internal-combustion engines which is more specifically directed to improving the return of a more purified fuel vapor back to the combustion chambers of the engine, whereby a more efficient operation of the engine is established to reduce the amount of pollutants that are released into the atmosphere.

The apparatus of the present invention comprises a canister that includes a housing having a top cover and a bottom cover which together define a chamber or reservoir that serves a dual purpose. That is, the canister provides a means to catch sediments of oil, sludge and solid particles, and to also provide a means to separate the intermixed fuel as a gas vapor and return the gas vapor back to the combustion chamber of the engine. The separation of the intermixed fuel is aided by the novel use of a permanent ceramic magnet which is positioned adjacent the upper cover member, whereby the incoming conglomerate residue from the valve cover of the engine is subjected to the magnetic fields of the magnet. As the residue passes through the magnetic poles of the magnet, the molecules of the fuel mixture are realigned and interconnected in a north-to-south arrangement. After being received in the canister chamber, the north magnetic field further aids in extracting the fuel and causes the fuel to become a more volatile gaseous vapor before being transferred back to the engine by way of the manifold. This establishes an important advantage of the invention which is to provide a new hydrocarbon separator that will extend the life of the engine by maintaining the oil in the crankcase in a cleaner state, and to return the unburned fuel mixture back to the combustion chamber of the engine, whereby the overall mileage of the vehicle is significantly increased and at the same time pollutant emission into the atmosphere are reduced.

Another object of the present invention is to provide a hydrocarbon separator and collector for crankcase emissions in which the sludge material is collected and stored in the canister until it is necessary to drain the contaminated contents through the lower cover member which includes a suitable drain device.

Still another object of the invention is to provide a hydrocarbon separator and collector apparatus for combustion engines, wherein the apparatus is relatively simple in construction, having no moving parts which makes it easy to use, and wherein the canister thereof is defined by a clear see-through housing for visual inspection of the chamber without the need to remove the canister from the PVC system.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Novel features and advantages of the present invention, in addition to those mentioned above, will become apparent to those skilled in the art from reading the following detailed description in conjunction with the accompanying drawings and numbered parts wherein.

DETAILED DESCRIPTION OF THE INVENTION

Figure 1:
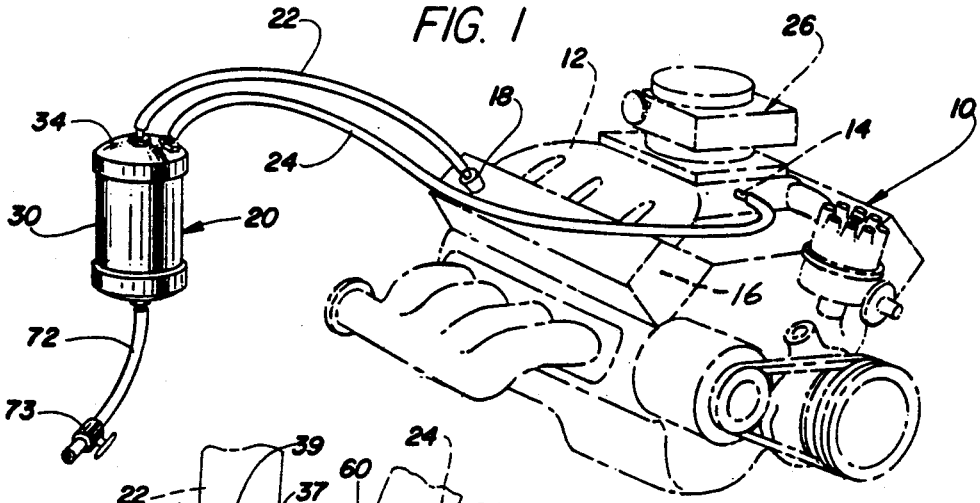
FIG. 1 is a pictorial view of the apparatus of the present invention illustrating the apparatus as being interconnected between the manifold of an internal-combustion engine, shown in phantom lines, and a typical PVC system which allows the polluted emissions from the crankcase to be discharged into the canister of the apparatus from the valve cover of the engine.

Referring more particularly to FIG. 1, there is shown a typical internal-combustion engine, generally indicated at 10, having a manifold 12 including an inlet port 14 located in the intake portion to the manifold and a valve or cam cover 16 which is provided with a suitable PVC valve 18. The apparatus for separating and collecting crankcase-emission gases is defined as a canister, indicated generally at 20, and shown as being interconnected to PVC valve 18 by means of an outlet hose 22 through, the contaminate gaseous elements from the crankcase being transferred from the rocker-arm area covered by rocker-arm cover 16 to canister 20. A second hose defined as an inlet hose 24 is connected at one end to canister 20 and at its opposite end to the manifold-inlet port 14 which is located just below the engine's carburetor or fuel injector, designated at 26. Crankcase emissions are commonly referred to as "blow-by" gases which are emitted from the engine 10 and through an outlet port provided in rocker-arm cover 16 of the engine. The contaminated gases consist of the unburned fuel mixture and other combustible products that are highly acidic, including water, carbon dioxide, carbon monoxide, sludge particles and heavy hydrocarbons.

Figure 2:
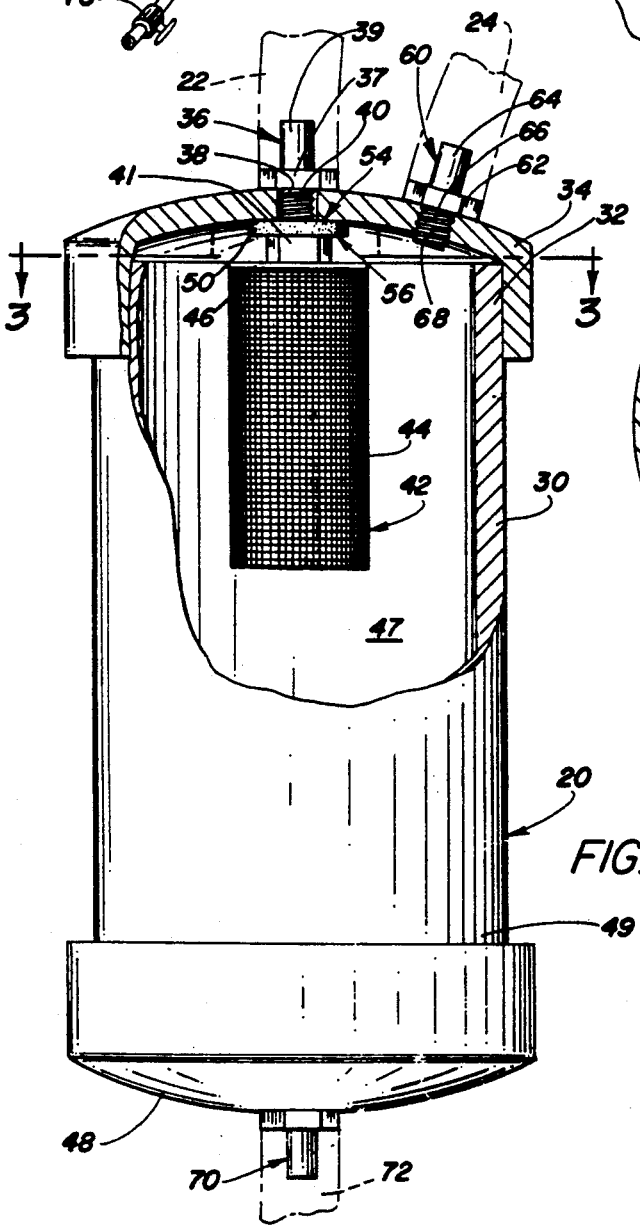
FIG. 2 is an enlarged side-elevational view of the canister, having the upper portion thereof broken away to show a separator screen mounted to the top cover member, with a permanent magnet interposed between the cover member and the separator screen.
Figure 3:
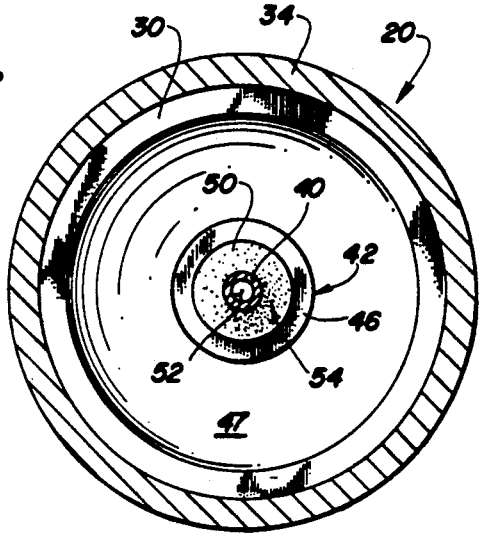
FIG. 3 is an enlarged cross-sectional view taken substantially along line 3—3 of FIG. 2 showing the canister chamber and the placement of the magnet.

Accordingly, the present apparatus, as herein illustrated in FIGSS. 2 and 3, comprises canister 20 which is defined by an elongated cylindrical housing 30 which is preferably formed from a suitable transparent (see-through) plastic material that is adapted to withstand the harsh acidic chemicals that are associated with "blow-by" gases, some of which are described above. The upper end 32 of canister 20 is closed and sealed by an upper cover plate 34 having a centrally positioned inlet port defined by a fitting 36 which is mounted on upper cover plate 34 through a central mounting hole 38. Fitting 36 is formed having an intermediate boss member 37 and an outer nipple end 39 which is adapted to receive one end of outlet hose 22. A threaded nipple end 40 formed under boss member 37 extends downwardly through mounting hole 38 so as to be secured to a nut member 41 which is affixed to a separator screen, generally indicated at 42. The separator screen is formed having a substantially cylindrical screen member 44 which is fixedly mounted to a plate 46 to which nut member 41 is directly attached. Thus, as can be seen in FIG. 2, separator screen 42 projects downwardly into a reservoir chamber 47 defined by housing 30, upper cover plate 34, and a lower cover plate 48 which is secured and sealed to the lower end 49 of housing 30. Prior to mounting separator screen 42 to the threaded end 40 of fitting 36, a permanent ceramic magnet 50 is positioned between nut member 41 and the bottom surface 33 of upper cover plate 34. Permanent ceramic magnet 50 is formed preferably as a circular flat member having a central hole 52 to receive the lower threaded nipple end 40, the magnet being positioned between nut member 41 and upper cover plate 34. Even though the magnetic fields may be positioned randomly for the operation of the apparatus, the preferred arrangement is to position the south magnetic field 54 of magnet 50 facing upwardly against the bottom surface 33, with the north magnetic field 56 of the magnet facing downwardly within reservoir chamber 47. The positioning of the north and south magnetic fields is important to the operation of the present invention and will be hereinafter described.

An outlet port is also provided in upper cover plate 34 and is defined by a fitting 60 having an intermediate boss member 62 on which is disposed an upper hose-connecting nipple 64 adapted to receive one end of inlet hose 24, and a lower threaded nipple 66 that is threadably mounted in a threaded bore 68 formed in upper cover plate 34. A discharge port or fitting 70 is mounted in the central portion of lower cover plate 48 to which is attached a drain hose 72 which is provided with a valve 73, as seen in FIG. 1, whereby the contaminated sludge and hydrocarbon residue can be removed from chamber 47 as may be needed.

As the contaminates within the "blow-by" residue from the crankcase, namely the liquids, solids and gaseous elements, are discharged from the valve or cam cover compartment through outlet hose 22 and into chamber 47 of the canister, the contaminated residue is subjected to the south and north magnetic fields of permanent magnet 50. First the residue passes through the south magnetic field, generally indicated at 54, wherein the contaminated elements of the hydrocarbon residue, particularly the gaseous elements, are affected first by the south magnetic field, whereby the molecules thereof are aligned in a north-to-south polarized arrangement. This polarization causes a change in the viscosity of the fluids and contents of the more volatile gases so that they flow more rapidly and freely as they enter chamber 47. That is, as the residue passes through the lower north magnetic field and begins to separate by means of passing through the separator screen 42, a fog-like vapor or mist condition is created within chamber 47. Thus, the elements are finely separated and more widely dispersed throughout chamber 47, and are thus more readily exposed to the north magnetic field emanating within the chamber. The highly acidic, volatile fuel mixture is affected in that the acidic content of the fuel mixture is considerably reduced thereby. This creates a much cleaner fuel mixture since the fuel is directed to pass through outlet fitting 60 and through hose 24 to the intake manifold by way of intake port 14, the fuel being returned to the combustion chamber of the engine for a more efficient burning during the operation of the engine. The remaining separated contaminated element, heavy sludge material, drops to the bottom of the chamber and is drained by means of hose 72 and discharge valve 73.

The above detailed description of the preferred embodiments describe the best mode contemplated by the inventors for carrying out the present invention at the time this application was filed and is offered by way of example and not by way of limitation. Accordingly, various modifications may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What we claim is:

1. A hydrocarbon and volatile gas separator for an internal combustion engine, comprising:

a canister formed having an enclosed reservoir chamber in which crankcase emissions of hydrocarbons and volatile gases are separated, and wherein the volatile gases are vaporized and returned to the internal-combustion engine so as to reburn therein;

an inlet fitting mounted in said canister and connected by a first hose to the engine to receive crankcase emissions therefrom;

a separator means for separating the hydrocarbons and volatile gases, wherein the volatile gases are vaporized as said gases pass through said separator means being attached to said inlet fitting and positioned within said canister;

a permanent magnet mounted to said inlet fitting and interposed between said canister and said separator means, and arranged to allow the hydrocarbons and volatile gases to pass through the magnetic field provided by said permanent magnet;

an outlet fitting mounted to said canister and connected by a second hose to the engine so as to return vaporized gases to the engine to be reburned therein; and a discharge fitting mounted to said canister, whereby the hydrocarbons are drained from said canister.

2. A hydrocarbon and volatile gas separator as recited in claim 1, wherein said canister comprises a housing having an upper cover plate and a lower cover plate, said first and second fittings being mounted in said upper cover plate so as to be positioned adjacent the upper portion of said canister, and said discharge fitting being mounted in said lower cover plate.

3. A hydrocarbon and volatile gas separator as recited in claim 2, wherein said permanent magnet is comprised of ceramic.

4. A hydrocarbon and volatile gas separator as recited in claim 3, wherein said discharge fitting includes a drain means.

5. A hydrocarbon and volatile gas separator as recited in claim 2, wherein said permanent magnet is formed having a central hole for mounting said permanent magnet to said first fitting, and wherein said hydrocarbons and said volatile gases are directed to pass through the south and north magnetic fields of said permanent magnet, whereby the molecules of said gases are polarized by said magnetic fields as said volatile gases are separated through said separator means which comprises a screen.

6. A hydrocarbon and volatile gas separator as recited in claim 5, wherein said south magnetic field of said permanent magnet is positioned adjacent the bottom surface of said upper cover plate, and said north magnetic field is positioned downwardly into said canister, whereby acid in said volatile gases is reduced.

7. A hydrocarbon and volatile gas separator as recited in claim 5, wherein said north magnetic field of said permanent magnet is positioned adjacent the bottom surface of said upper cover plate, and said south magnetic field is positioned downwardly into said canister, whereby acid in said volatile gases is reduced thereby.

8. A method of separating hydrocarbon crankcase emissions consisting of hydrocarbons and volatile gaseous fuels and returning the volatile gaseous fuels to an intake manifold of an internal combustion engine, comprising the steps of:

providing a canister to receive hydrocarbons and volatile gaseous fuels from the internal-combustion engine, said canister being formed having an enclosed reservoir chamber, an inlet port, an outer port, and a discharge port;

receiving said hydrocarbons and volatile gaseous fuels through said inlet port;

passing said hydrocarbons and volatile gaseous fuels through a magnetic field of a permanent magnet mounted adjacent the inlet port thereof, whereby said volatile gaseous fuels are polarized by said magnetic field;

separating said hydrocarbons and volatile gaseous fuels through a separator screen;

returning said polarized gaseous fuels to the intake manifold of the internal combustion engine through said outlet port of said canister; and allowing said hydrocarbons to be stored in said canister for removal therefrom by way of said discharge port as needed.

9. A method of separating hydrocarbon crankcase emissions as recited in claim 8, wherein said magnetic field is provided by a permanent ceramic magnet having a south magnetic field on one side thereof and a north magnetic field on the opposite side thereof.

10. A method of separating hydrocarbon crankcase emissions as recited in claim 9, wherein said north magnetic field is positioned adjacent said inlet port and said south magnetic field is positioned adjacent said separator screen, and wherein said south magnetic field extends downwardly inside said reservoir chamber.

11. A method of separating hydrocarbon crankcase emissions as recited in claim 9, wherein said south magnetic field is positioned adjacent said inlet port and said north magnetic field is positioned adjacent said separator screen, and wherein said north magnetic field extends downwardly inside said reservoir chamber.

12. A method of separating hydrocarbon crankcase emissions as recited in claim 9, wherein said canister is defined by a cylindrical housing having a top cover member and a bottom cover member, and wherein a first fitting is mounted in said inlet port and a second fitting is mounted in said outlet port, said inlet and outlet ports being disposed in said top cover member, and a discharge fitting being mounted in said discharge port disposed in said bottom cover member.

13. A method of separating hydrocarbon crankcase emissions as recited in claim 12, wherein said permanent ceramic magnet is formed having a central hole for mounting said permanent magnet to said first fitting, and wherein said hydrocarbons and said volatile gases are directed to pass through the south and north magnetic fields of said permanent magnet, whereby the molecules of said gases are polarized by said magnetic fields as said volatile gases are separated through said separator screen.

14. A method of separating hydrocarbon crankcase emissions as recited in claim 13, wherein acidity in said volatile gases is reduced as said volatile gases are passed through said north and south magnetic fields, whereby said volatile gases are efficiently burned after returning to said intake manifold.

* * * * *